US008449088B2

(12) United States Patent
Rittgers et al.

(10) Patent No.: US 8,449,088 B2
(45) Date of Patent: May 28, 2013

(54) MAKING PRINT CARTRIDGE USING TWO HOLLOW NEEDLES

(75) Inventors: Jon Rittgers, Co. Kildare (IE); Fionnula Farrell, Co. Kildare (IE); Edward Savage, Co. Kildare (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 370 days.

(21) Appl. No.: 12/532,608

(22) PCT Filed: Apr. 30, 2008

(86) PCT No.: PCT/US2008/005569
§ 371 (c)(1),
(2), (4) Date: Sep. 22, 2009

(87) PCT Pub. No.: WO2008/137004
PCT Pub. Date: Nov. 13, 2008

(65) Prior Publication Data

US 2010/0132830 A1 Jun. 3, 2010

(30) Foreign Application Priority Data

Apr. 30, 2007 (GB) ..... 0708268.8

(51) Int. Cl.
*B41J 2/175* (2006.01)

(52) U.S. Cl.
USPC ..... 347/85; 347/7

(58) Field of Classification Search
CPC ..... B41J 2/17506
USPC ..... 347/85
See application file for complete search history.

(56) References Cited

U.S. PATENT DOCUMENTS 5,479,968 A * 1/1996 Sanchez et al. ..... 347/85
5,790,158 A * 8/1998 Shinada et al. ..... 347/86
6,234,618 B1 * 5/2001 Yamamoto et al. ..... 347/86

(Continued)

FOREIGN PATENT DOCUMENTS

EP 639501 A1 2/1995
EP 1080914 A2 3/2001

(Continued)

OTHER PUBLICATIONS

Supplementary Euopean Seach Report for Applicaion No. EP 08767462.8-1251/2152517 based on PCT/US2008/005569.

(Continued)

*Primary Examiner* — Shelby Fidler

(57) ABSTRACT

A method of making a print cartridge comprises providing an ink housing 100 having a top and a base and at least one interior compartment 106, the housing further having a passageway 172, 174 in the base with an entrance in the compartment to allow fluid communication between the interior of the compartment and a print head 160 mounted at the base of the housing. A block of hydrophobic foam material 252 is inserted under compression into the compartment immediately above the passageway entrance. Ink 710, 712 is injected into the foam block through two hollow needles 702, 704 extending downwardly through the block from the top of the housing and terminating at points disposed respectively towards opposite edges 174*a*, 174*b* of the passageway entrance. The volume of ink injected by the needles is sufficient to fill the passageway and cover the passageway entrance but insufficient to form a horizontal air seal around the internal periphery of the compartment.

12 Claims, 3 Drawing Sheets

U.S. PATENT DOCUMENTS

| | | | | |
|---|---|---|---|---|
| 6,238,042 | B1 | 5/2001 | Kobayashi et al. | |
| 6,364,473 | B1 | 4/2002 | Liu | |
| 8,033,625 | B2 * | 10/2011 | Kucmerowski et al. | 347/7 |
| 2005/0219333 | A1 * | 10/2005 | Yuen | 347/85 |
| 2007/0285476 | A1 * | 12/2007 | Freire et al. | 347/85 |
| 2008/0100678 | A1 * | 5/2008 | Childers et al. | 347/85 |

FOREIGN PATENT DOCUMENTS

| | | | |
|---|---|---|---|
| EP | 1090766 | | 4/2001 |
| GB | 2326379 | A | 12/1998 |
| JP | 2005297446 | | 10/2005 |
| JP | 2006159656 | A * | 6/2006 |
| JP | 2006224433 | | 8/2006 |
| WO | WO 2007042080 | A1 * | 4/2007 |
| WO | WO 2008134552 | A1 * | 11/2008 |

OTHER PUBLICATIONS

International Search Report and Written Opinion. Mail Date Oct. 21, 2008 for International Application No. PCT/US2008/005569, filed Apr. 30, 2008.

* cited by examiner

MAKING PRINT CARTRIDGE USING TWO HOLLOW NEEDLES

The present invention relates to a print cartridge.

Referring to the drawings, a colour print cartridge for a desktop ink jet printer comprises a housing 100 whose interior is divided by partitions 150, 152 into three compartments (or ink reservoirs) 106, 108 and 110, each for containing a differently colored ink. As seen in FIG. 1, compartments 106 and 108 are located side-by-side across the rear of the housing while compartment 110 extends across the full width of the front of the housing (in the present specification top, bottom, front, rear and like expressions refer to the orientation of the cartridge shown in the drawings).

A print head die 160 is attached to the base of the print cartridge housing 100. The print head 160 includes slots which align with outlet ports 120, 130 and 140 in the base of the housing 100. The bottom of the compartment 106 includes an exit port 170 that opens into a cavity 172 of the housing 100 to provide fluid communication between the interior of the compartment 106 and the print head 160 via the outlet port 130. Similarly, the compartment 110 is in fluid communication with the print head 160 via a cavity 182 and the outlet port 140, FIG. 2, and the compartment 110 is in fluid communication with the print head 160 via a cavity (not shown but similar to cavities 172, 182) and the outlet port 120.

A duct (or standpipe) 174 located within the compartment 106 is connected to the exit port 170, FIG. 1. The entrance to the standpipe 174 is above the bottom of the compartment 106. The standpipe 174 constitutes the only exit from the compartment 106 to the print head 160. Similar standpipes 178, 180 for compartments 108, 110 respectively can be seen in FIG. 2, each having an entrance above the bottom of the respective compartment and constituting the only exit from the compartment to the print head 160. Respective filters 195, shown only in FIG. 3, are fitted over the entrance to each standpipe.

In order to charge the cartridge with ink, a respective foam block (not shown in FIGS. 1 and 2) is pre-compressed and push fitted into each compartment 106, 108, 110. Only the foam block 252 for the compartment 106 is shown in FIG. 3, but a similar foam block will be inserted into each compartment. Each block is generally rectangular and conforms closely to the side walls of the respective compartment. The bottom surface of each block sits on top of a respective standpipe filter 195 and defines a free space (herein referred to as a snout region) laterally adjacent each standpipe at the bottom of each compartment below the foam block. In the drawings the snout regions for compartments 108, 110 are indicated by numerals 188, 190 respectively (the snout region for the compartment 106 is not visible in the drawings). The general structure of the cartridge, insofar as it has been described so far, may be the same as that shown in U.S. Pat. No. 6,851,800.

Before charging the cartridge, a lid 166, FIG. 3, is fitted to the top of the housing 100. Within the lid 166 at least one hole 167 is formed above each standpipe. The cartridge is subjected to a vacuum with air being drawn downwardly through the compartments from the base of the housing through their respective standpipes. Respective hollow ink dispensing needles are introduced through the holes in the lid into the body of the foam blocks filling the compartments. FIG. 3 shows two such needles 702, 704 inserted into the foam block 252 and terminating at points disposed respectively towards opposite front and rear edges 174*a* and 174*b* of the standpipe 174. As will be described, in the prior art only one of these two needles will normally be used for any given filling operation. Typically, the foam employed is polyurethane which is strongly hydrophobic when dry. Ink dispensed by the needles is therefore forced into the foam and the ink expands outwardly and downwardly within the foam until the ink meets an outside surface of the foam block. Typically, the ink will first meet the underside of the foam block above the standpipe, at which time the ink will tend to be drawn into and fill the standpipe and associated cavity before spreading further into the foam. Thereafter, the ink settles and spreads out in the compartment and, if enough ink is injected, it will ultimately meet the sidewalls of the compartment all round the internal periphery of the compartment to form a horizontal air seal within the foam block, as well as eventually fill the snout region itself.

Once the ink has been dispensed, the needles are withdrawn, and the cartridge is removed from the vacuum. The holes in the lid may be covered, for example with a label, although they should not be sealed so that they can act as air vents to allow ink to be drawn downwardly from the compartments during use of the cartridge.

Recently, there has been a demand to supply ink cartridges of a given format (i.e. exterior size and shape) with varying levels of ink capacity. So, for example, more intense printer users may wish to purchase high capacity cartridges for their printer containing, for example, 8 ml of ink per compartment, whereas low use users may wish to purchase low capacity cartridges containing, for example, 1 ml of ink per compartment for the same model of printer. Clearly, each of these cartridges needs to be of the same format to be compatible with the printer. Heretofore, colour print cartridges with different ink capacities have been manufactured simply by injecting different quantities of ink into each compartment 106, 108 and 110. Thus, for high capacity cartridges substantially the entire volume of each compartment is filled with ink. However, for low capacity cartridges, in each compartment ink is injected only into a limited region of the respective foam block adjacent the standpipe entrance.

Since the snout region laterally adjacent each standpipe is non-symmetrical relative to the standpipe entrance, i.e. each standpipe is not disposed centrally within its respective compartment, a different one of the two needles available to inject ink into each compartment is used according to whether the cartridge is to be charged to a high capacity or a low capacity. For example, for the compartment 106, the needles 702 and 704 terminate, relative to the centre of the standpipe 174, at points disposed respectively towards the front and rear edges 174*a*, 174*b* of the standpipe entrance. This reflects the fact that the snout region 188 itself is non-symmetrical relative to these edges, being narrower and deeper in front of the standpipe than behind it. For lower capacity applications, needle 702 is used to charge the compartment 106 whereas for higher capacity applications needle 704 is used to charge the compartment. This choice of needles, and their positioning, reflects the different flow dynamics of the ink relative to the non-symmetrical snout region. It will be understood that the other compartments 108 and 110 are likewise charged with one of two needles according to whether the cartridge is to be filled to a high or low capacity, the needles terminating at points disposed respectively towards opposite edges of the respective standpipe entrance relative to which the respective snout region is non-symmetrical.

For the very lowest capacity charging of the cartridge, in each compartment it is desirable to charge an area of the foam block just covering the entrance to the standpipe.

Intuitively, one would expect that this would involve positioning a needle directly over the centre of the standpipe, as indicated by the dashed needle position 706 for the compartment 106. However, in order to accommodate such a needle position, either the lid for the cartridge would need to be re-worked to include three needle holes for each of compartments 106, 108 and 110; or a different lid would need to be employed depending on whether the cartridge was to be charged to low, intermediate or high capacity.

According to the present invention there is provided a print cartridge as claimed in claim 1.

An embodiment of the invention will now be described, by way of example, with reference to the accompanying drawings, in which.

Figure 1:
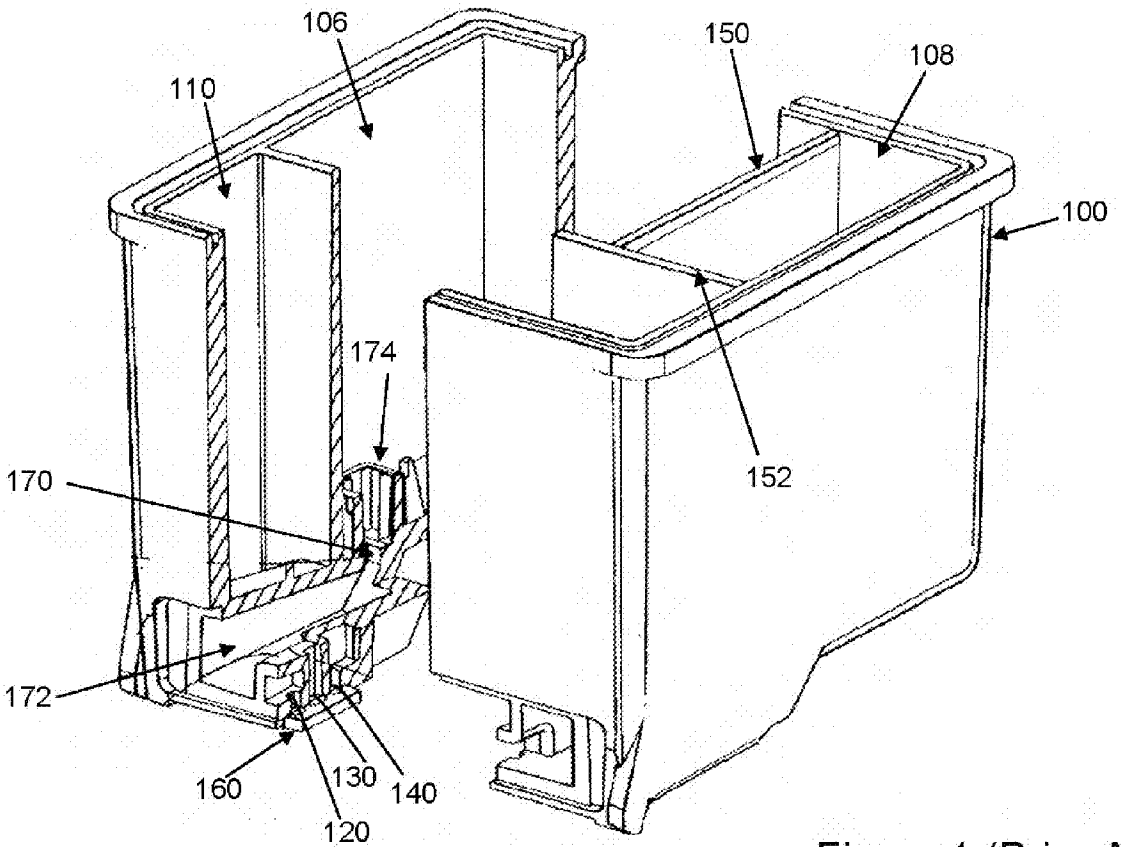
Figure 1 (Prior Art)
FIG. 1 is a perspective view of a conventional print cartridge into which ink may be injected according to an embodiment of the invention.
Figure 2:
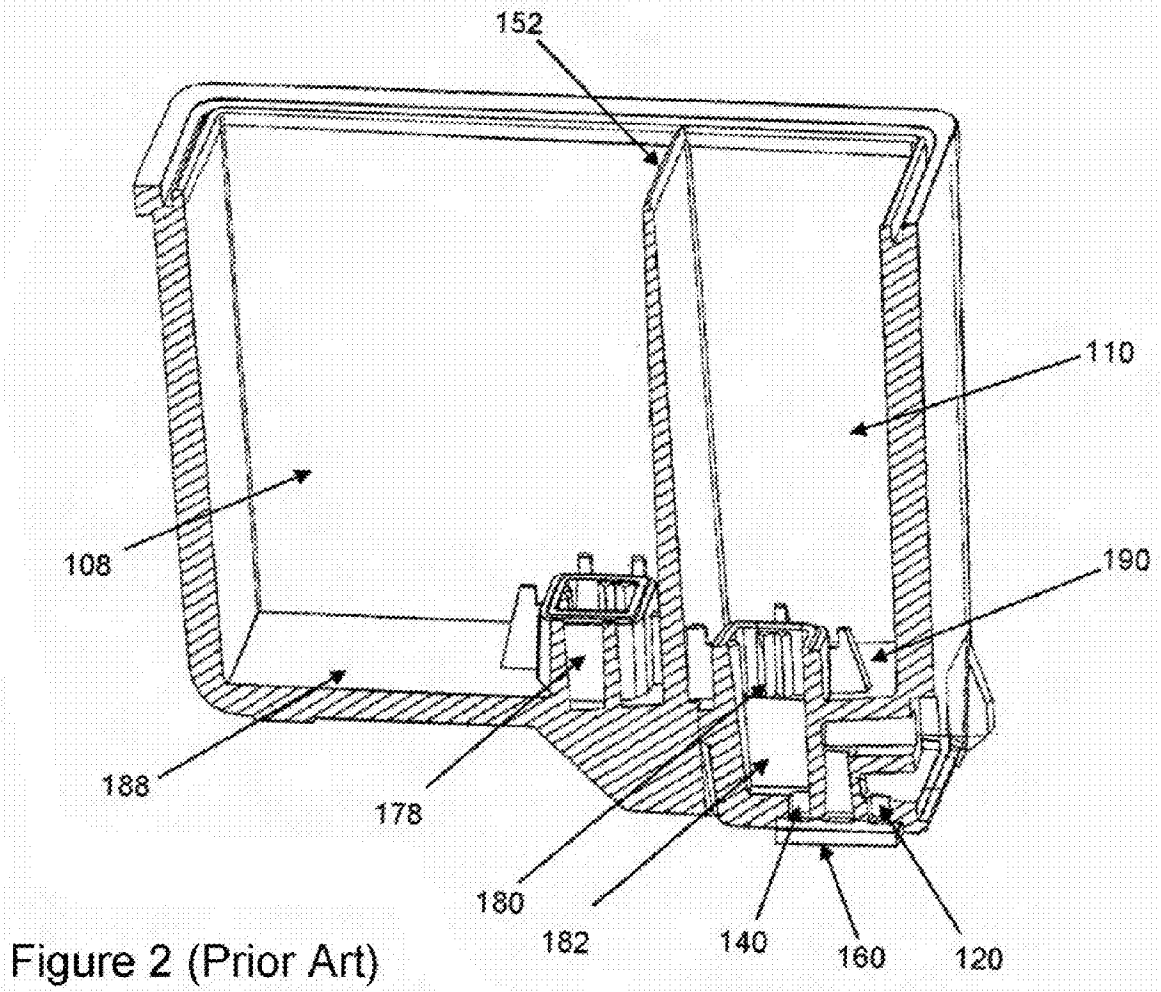
Figure 2 (Prior Art)
FIG. 2 is a perspective view of a front-to-rear section of the print cartridge of FIG. 1.
Figure 3:
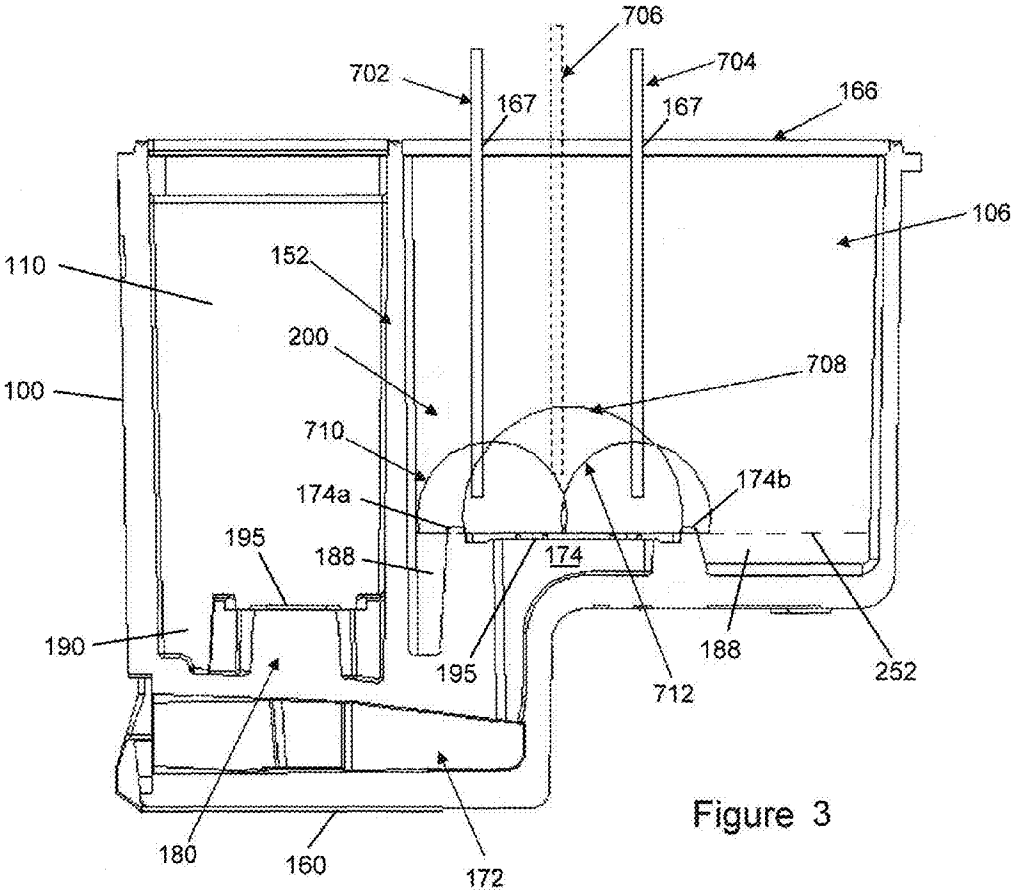
FIG. 3 is a vertical cross-section of the cartridge of FIGS. 1 and 2 showing the cartridge being charged with ink according to an embodiment of the invention.

As mentioned, intuitively it would seem that one would use a single, centrally placed needle to charge a compartment to the lowest capacity with ink of the appropriate colour for that compartment; for example, the needle 706 for the compartment 106. When dispensed from the end of such a needle 706, the ink spreads outwardly and downwardly through the foam block 252 until it meets the standpipe 174. The ink then fills the cavity 172 and continues to do so until the standpipe fills. Ink then continues to fill the foam block until the surface of the standpipe is fully covered. At this time, the ink will have a domed profile generally as indicated by the line 708.

Surprisingly, however, it has been found that for the very lowest capacity applications, using both the existing needles 702 and 704 to charge the compartment results in the ink filling the foam block with the dual profiles indicated by the lines 710, 712. This requires less ink to charge the standpipe 174 than using a single needle located centrally over the standpipe, as well as obviating the need to employ a new needle position to accommodate a full range of cartridge capacities.

The two needles 702 and 704 can inject ink into the foam block 252 substantially simultaneously, each dispensing substantially the same volume of ink over the same period of time. However, other arrangements are possible. The total volume of ink injected by the two needles should be sufficient to fill the cavity 172 and standpipe 174 and cover the standpipe entrance. It can be limited to the minimum amount necessary to just cover the standpipe entrance, but in any event it should be insufficient to form a horizontal air seal around the internal periphery of the compartment, i.e. the ink in the foam block should not meet the interior sidewalls of the compartment continuously all round.

Although the above has primarily described the charging of the compartment 106 to a very low ink level using the needles 702 and 702, the other compartments may be similarly charged to a very low ink level using the same technique.

The invention is not limited to the embodiment described herein but can be amended or modified without departing from the scope of the present invention.

The invention claimed is:

1. A method of making a print cartridge comprising:

providing an ink housing having a top and a base and at least one interior compartment, the housing further having a passageway in the base with an entrance in the compartment to allow fluid communication between an interior of the compartment and a print head mounted at the base of the housing, inserting a block of hydrophobic foam material under compression into the compartment immediately above the passageway entrance, inserting two hollow needles through the foam block so a first needle terminates closer to a first edge of the passageway entrance than a second edge of the passageway entrance opposite the first edge, and a second needle terminates closer to the second edge than the first edge;

injecting an ink into the foam block through the needles, a total volume of ink injected by the needles being sufficient to fill the passageway and cover the passageway entrance but insufficient to reach all sidewalls of the foam block in a final state of the print cartridge.

2. A method as claimed in claim 1, wherein the passageway entrance is located above the bottom of the compartment so that a free space is defined laterally adjacent the passageway below the foam block, wherein the free space is non-symmetrical relative to said opposite edges of the passageway entrance.

3. A method as claimed in claim 1 or 2, wherein each needle injects substantially a same volume of ink into the foam block.

4. A method as claimed in claim 3, wherein the needles inject ink into the foam block substantially simultaneously.

5. A method as claimed in claim 4, wherein the housing has a plurality of interior compartments each in fluid communication with the print head via a respective passageway having an entrance in the respective compartment, and a respective block of hydrophobic foam material under compression in each compartment, the method including injecting a differently colored ink into each compartment using two needles as aforesaid.

6. A method as claimed in claim 3, wherein the housing has a plurality of interior compartments each in fluid communication with the print head via a respective passageway having an entrance in the respective compartment, and a respective block of hydrophobic foam material under compression in each compartment, the method including injecting a differently colored ink into each compartment using two needles as aforesaid.

7. A method as claimed in claim 1 or 2, wherein the needles inject ink into the foam block substantially simultaneously.

8. A method as claimed in claim 7, wherein the housing has a plurality of interior compartments each in fluid communication with the print head via a respective passageway having an entrance in the respective compartment, and a respective block of hydrophobic foam material under compression in each compartment, the method including injecting a differently colored ink into each compartment using two needles as aforesaid.

9. A method as claimed in claim 1 or 2, wherein the housing has a plurality of interior compartments each in fluid communication with the print head via a respective passageway having an entrance in the respective compartment, and a respective block of hydrophobic foam material under compression in each compartment, the method including injecting a differently colored ink into each compartment using two needles as aforesaid.

10. A method as claimed in claim 1, wherein injecting the ink into the foam block through the two hollow needles results in the ink filling the foam block with dual profiles over the passageway entrance.

11. A method as claimed in claim 1, wherein the needles are located equal distance from a center of the passageway entrance.

12. A method as claimed in claim 1, wherein the first needle is located directly above the first edge and the second needle is located directly above the second edge.

* * * * *

UNITED STATES PATENT AND TRADEMARK OFFICE

CERTIFICATE OF CORRECTION

PATENT NO. : 8,449,088 B2
APPLICATION NO. : 12/532608
DATED : May 28, 2013
INVENTOR(S) : Jon Rittgers et al.

It is certified that error appears in the above-identified patent and that said Letters Patent is hereby corrected as shown below:

On the Title page, in item (75), Inventors, in column 1, line 1, delete "Fionnula" and insert -- Fionnuala --, therefor.

Signed and Sealed this
Tenth Day of September, 2013

Teresa Stanek Rea
*Acting Director of the United States Patent and Trademark Office*